United States Patent [19]

Matsuda

[11] 4,106,307

[45] Aug. 15, 1978

[54] REVERSE-FLOW AIR CONDITIONER

[75] Inventor: Toshiharu Matsuda, Kudamatsu, Japan

[73] Assignee: Hitachi, Ltd., Tokyo, Japan

[21] Appl. No.: 774,487

[22] Filed: Mar. 4, 1977

[30] Foreign Application Priority Data

Mar. 5, 1976 [JP] Japan ..... 51-23270
May 12, 1976 [JP] Japan ..... 51-26136

[51] Int. Cl.[2] ..... F25B 13/00; F25B 43/00
[52] U.S. Cl. ..... 62/324; 62/503
[58] Field of Search ..... 62/324, 503, 160; 165/62

[56] References Cited

U.S. PATENT DOCUMENTS

| | | | |
|---|---|---|---|
| 2,977,773 | 4/1961 | De Kanter | 62/324 |
| 3,350,898 | 11/1967 | Harnish | 62/324 |
| 3,423,954 | 1/1969 | Harnish et al. | 62/324 |
| 3,552,140 | 12/1968 | Palmer | 62/324 |
| 4,030,315 | 6/1977 | Harnish | 62/503 |

*Primary Examiner*—Lloyd L. King
*Attorney, Agent, or Firm*—Beall & Jeffery

[57] ABSTRACT

A reverse-flow air conditioner comprises a compressor for delivering a hot compressed refrigerant gas, a four-way valve for shifting the flow direction of the refrigerant, indoor and outdoor heat exchangers for separately accomplishing the condensation and evaporation of the refrigerant during cooling and heating cycles, a receiver communicated with the both heat exchangers, decompression means for changing the liquid refrigerant, condensed by the indoor or outdoor heat exchanger depending on whether the cycle is for cooling or heating, into a mixture of gaseous and liquid refrigerant portions, and a suction accumulator for separating the refrigerant, vaporized by the indoor or outdoor heat exchanger according to the cycle, into gaseous and liquid portions, the components being interconnected by refrigerant piping. The refrigerant line between the indoor heat exchanger and the four-way valve is integrally connected to that between the four-way valve and the suction accumulator so that heat is exchanged, during the heating cycle, between the refrigerant flowing into the suction accumulator and the hot refrigerant gas from the compressor and, during the cooling cycle, between the refrigerants leaving the indoor heat exchanger and flowing into the suction accumulator.

9 Claims, 8 Drawing Figures

REVERSE-FLOW AIR CONDITIONER

BACKGROUND OF THE INVENTION

This invention relates to a reverse-flow air conditioner, and more specifically to such air conditioner equipped with heat exchanger means particularly adapted for use during the heating cycle.

Conventional heat pumps or reverse-flow air conditioners typically comprise a compressor, four-way valve, outdoor heat exchanger, check valves, decompression devices (expansion valves or capillary tubes), receiver, indoor heat exchanger, and suction accumulator, all connected functionally by refrigerant lines.

In the existing conditioner, during the cooling operation, the hot compressed refrigerant gas delivered from the compressor flows through the four-way valve into the outdoor heat exchanger, where it condenses to a liquid as it gives up its heat to air or water. The liquid refrigerant passes through the first check valve and receiver to the second decompression device, where it is adiabatically expanded to a low-temperature, low-pressure mixture of gaseous and liquid refrigerant portions. The mixture then enters the indoor heat exchanger, where the liquid refrigerant is further gasified by heat exchange with air or water for space cooling. The gaseous refrigerant flows through the other path of the four-way valve into the suction accumulator. There it is separated from the liquid portion left unvaporized, and thus the gaseous refrigerant alone returns to the compressor.

During the heating operation, the hot compressed refrigerant gas from the compressor passes through the four-way valve into the indoor heat exchanger, and accomplishes space heating while being condensed to a liquid through the exchange of heat with air or water. The liquid refrigerant runs through the second check valve and receiver to the first decompression device. After the pressure reduction the refrigerant enters the outdoor heat exchanger, where it pumps or collects heat by exchanging heat with air or water. From the outdoor heat exchanger the refrigerant returns to the compressor via the other path of the four-way valve and the suction accumulator.

Such conventional reverse-flow air conditioners present problems as follows. When the outdoor temperature falls during the heating operation, the evaporation temperature of the refrigerant in the outdoor heat exchanger drops with a consequent decrease in the heat-pumping capacity of the refrigerant therein, allowing more unvaporized refrigerant to flow in the liquid form into the suction accumulator. Thus oversupply of the liquid refrigerant beyond the gas-liquid separation capacity of the suction accumulator will cause part of the refrigerant still in the liquid form to flow back to the compressor. This can induce liquid hammering or oil foaming, which will damage the compressor.

In an effort to prevent the return of the liquid refrigerant to the compressor during the heating operation, it has been proposed to combine the receiver and the suction accumulator in a single, integral unit so as to vaporize the liquid refrigerant in the suction accumulator with the heat transferred from the relatively hot liquid refrigerant in the receiver. The proposed arrangement has, however, proved disadvantageous because, during the cooling operation under such high-temperature conditions that the refrigerant gas in the suction accumulator is already superheated, the refrigerant gas returning to the compressor is so hot that the temperatures of the motor and bearings of the compressor rise unusually, tending to cause a trouble.

As stated, the problems common to the ordinary heat pump units for air conditioning have been that the liquid refrigerant returns to the compressor during the heating operation, and that an attempt to avoid it, in turn, results in excessive super heat of the refrigerant gas entering the compressor and hence damaging of the compressor during the cooling operation.

SUMMARY

The present invention aims at solving the foregoing problems and providing a reverse-flow air conditioner in which the compressor is protected against the above-described troubles, without adding any novel or extra device therefor.

The object of the invention is realized by a reverse-flow air conditioner comprising a compressor for delivering a hot compressed refrigerant gas, a four-way valve for shifting the flow direction of the refrigerant, indoor and outdoor heat exchangers for separately accomplishing the condensation and evaporation of the refrigerant during cooling and heating cycles, a receiver communicated with the both heat exchangers, decompression means for changing the liquid refrigerant, condensed by the indoor or outdoor heat exchanger depending on whether the cycle is for cooling or heating, into a mixture of gaseous and liquid refrigerant portions, and a suction accumulator for separating the refrigerant, vaporized by the indoor or outdoor heat exchanger according to the cycle, into gaseous and liquid portions, the components being interconnected by refrigerant piping, characterized in that, in the refrigerant line where the refrigerant, vaporized by either the indoor or outdoor heat exchanger during the cooling or heating operation, flows on its way back to the compressor, there is provided heat exchanger means for heating the returning refrigerant during the heating cycle but not heating the same during the cooling cycle.

BRIEF DESCRIPTION OF THE DRAWING

Further objects, features and advantages of the present invention will become more clear from the following description of a preferred embodiment, with variations, as shown in the drawing, wherein.

DETAILED DESCRIPTION OF THE PREFERRED EMBODIMENT

Figure 1:
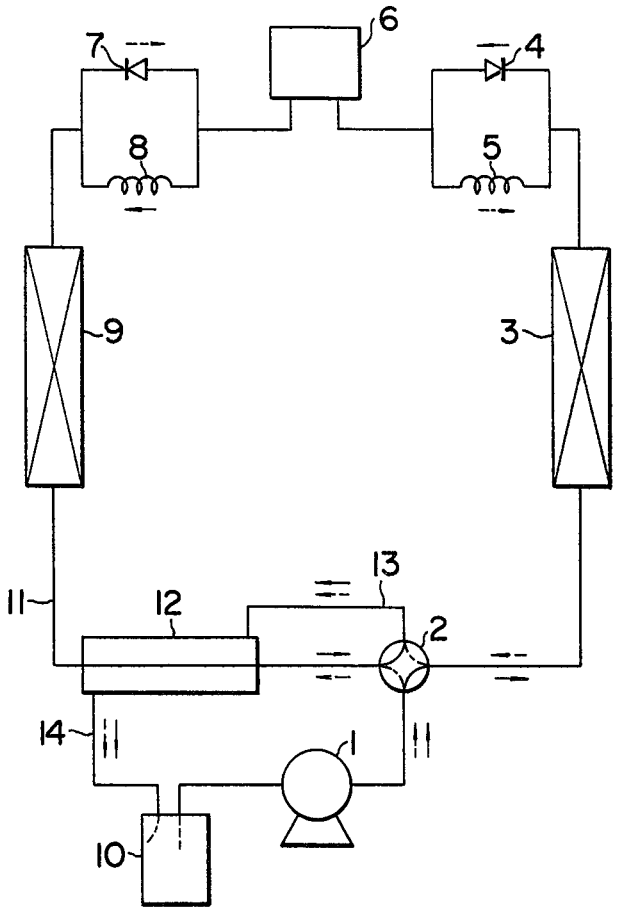
FIG. 1 is a flow diagram of a reverse-flow air conditioner embodying the invention, for illustration of the reversible operation cycle.

Referring to FIG. 1, a reverse-flow air conditioner embodying the invention is shown as comprising a compressor 1, four-way valve 2, outdoor heat exchanger 3, first check valve 4, first decompression device 5, receiver 6, second check valve 7, second decompression device 8, indoor heat exchanger 9, and suction accumulator 10, all connected functionally in that order by refrigerant piping.

Figure 2:
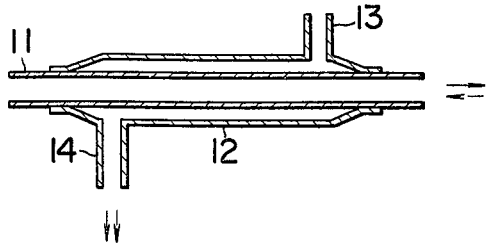
FIG. 2 is a sectional view of heat exchanger means for use in the embodiment of FIG. 1, consisting of an integral combination of the line between the indoor heat exchanger and the four-way valve and the line between the four-way valve and the suction accumulator.

Of this arrangement, as shown better in FIG. 2, part of the line 11 between the indoor heat exchanger 9 and the four-way valve 2 is covered by an outer pipe 12, with the inlet and outlet of the outer pipe 12 communicated with the four-way valve 2 and the suction accumulator 10, respectively, by an inlet pipe 13 and an outlet pipe 14.

During the heating cycle, the hot compressed refrigerant gas, delivered from the compressor 1 in the direction of broken-line arrows, flows through one of the paths, indicated by broken lines, of the four-way valve 2 into the indoor heat exchanger 9 that serves as a condenser, where it is condensed to a liquid while giving up the heat to the air for the space being conditioned. The liquid refrigerant passes through the second check valve 7 and liquid receiver 6 into the first decompression device 5, where it is reduced in pressure and adiabatically expanded to the form of a gas-liquid mixture. The refrigerant then enters the outdoor heat exchanger 3 that functions as an evaporator, where it is vaporized while extracting heat from the outdoor air. From the exchanger 3 the refrigerant flows through the other broken-line path of the four-way valve 2 and the inlet pipe 13 into the outer pipe 12. There it undergoes exchange of heat with the hot compressed refrigerant gas flowing through the line 11, so that the liquid refrigerant portion that escaped the vaporizing action of the outdoor heat exchanger 3 is mostly changed to a gas. By way of the outlet pipe 14, the refrigerant enters the suction accumulator 10, where it is completely separated from the residual liquid portion, and is finally returned in the gaseous form to the compressor 1.

During the cooling cycle, the hot compressed refrigerant gas is delivered from the compressor 1 in the direction indicated by full-line arrows, and is conducted through one of the full-line paths of the four-way valve 2 to the outdoor heat exchanger 3 that operates as a condenser, where it is condensed to a liquid. Next, the liquid flows through the first check valve 4 and the receiver 6 into the second decompression device 8, where it is reduced in pressure and adiabatically expanded to the form of a gas-liquid mixture. The mixture then enters the indoor heat exchanger 9 that acts as an evaporator, where it is vaporized and, during that course, absorbs heat from the supply air to the conditioned space. The refrigerant leaving the indoor heat exchanger 9 passes through the line 11, the other full-line path of the four-way valve 2, inlet pipe 13, outer pipe 12, and outlet pipe 14 into the suction accumulator 10, where it is freed from the liquid portion and is sent back in the gaseous form to the compressor 1.

The embodiment being described offers the following advantages. During the heating cycle where the outdoor temperature is low enough to bring most of the refrigerant in the liquid form into the suction accumulator 10, the gas-liquid mixture that flows through the outer pipe 12 is heated by the hot refrigerant gas flowing through the line 11. Consequently, most of the liquid refrigerant portion is changed to a gas there and any objectionable return of the liquid refrigerant to the compressor 1 can be prevented. During the cooling cycle, where the refrigerant that leaves the indoor heat exchanger 9 working as an evaporator is mostly in the gaseous form or rather in a superheated state, the refrigerant from the line 11 immediately enters the outer pipe 12 and therefore the quantity of heat to be transferred is small and there is no need of superheating the refrigerant to excess before it returns to the compressor 1.

Figure 3:
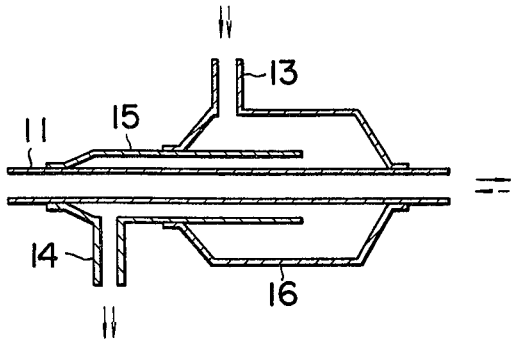
FIG. 3 is a sectional view of a modification of the heat exchanger means, consisting of an integral combination of the line between the indoor heat exchanger and the four-way valve and the line between the four-way valve and the suction accumulator.

FIG. 3 illustrates a modification of the aforedescribed embodiment of the invention, which combines the suction accumulator 10 and the outer pipe 12 of FIG. 1 in a unitary assembly. Here the outer cylinder 16 serves as the suction accumulator 10 and the inner pipe 15 as the outer pipe 12. Desirably the inlet pipe 13 is open tangentially to the peripheral portion of the outer pipe 16 to provide a swirl of the refrigerant and centrifugally achieve gas-liquid separation with enhanced efficiency.

With a simple construction, this modification makes it possible, during the heating operation, to prevent the return of liquid refrigerant to the compressor by the centrifugal action due to the swirling of the refrigerant and by exchange of heat with the gas delivered from the compressor. Also, the modification during the cooling operation permits separation of the liquid refrigerant from the gaseous portion solely by the centrifugal action without overheating the refrigerant.

In still another modification the relative positions of the pipe 11 and the outer pipe 12 in FIG. 1 may be reversed to attain the same advantageous effect. Further, the suction accumulator 10 may be located between the four-way valve 2 and the outer pipe 12 instead of as shown, without any deleterious effect.

Figure 4:
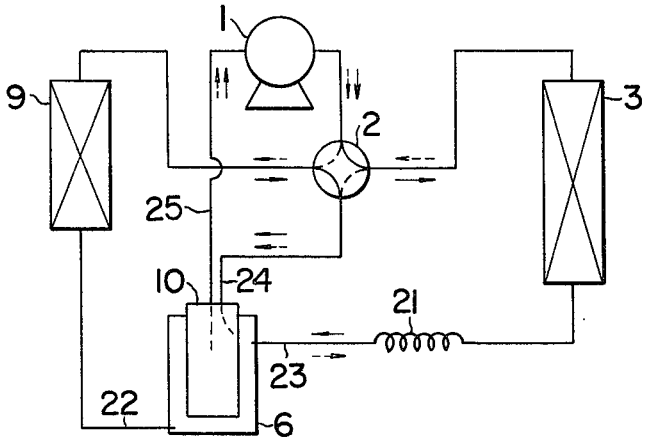
FIG. 4 is a flow diagram of another embodiment of the invention, for illustration of the reversible operation cycle.

Another embodiment of the reverse-flow air conditioner of the invention is represented as a flow diagram in FIG. 4.

In this embodiment the refrigerant circuit comprises the compressor 1, four-way valve 2, outdoor heat exchanger 3, decompression device 21, receiver 6, indoor heat exchanger 9, and suction accumulator 10 installed within the receiver 6. The lower part of the receiver 6 is communicated with the indoor heat exchanger 9 through a lower line 22, and the upper part of the receiver is communicated with the decompression device 11 through an upper line 23.

Figure 5:
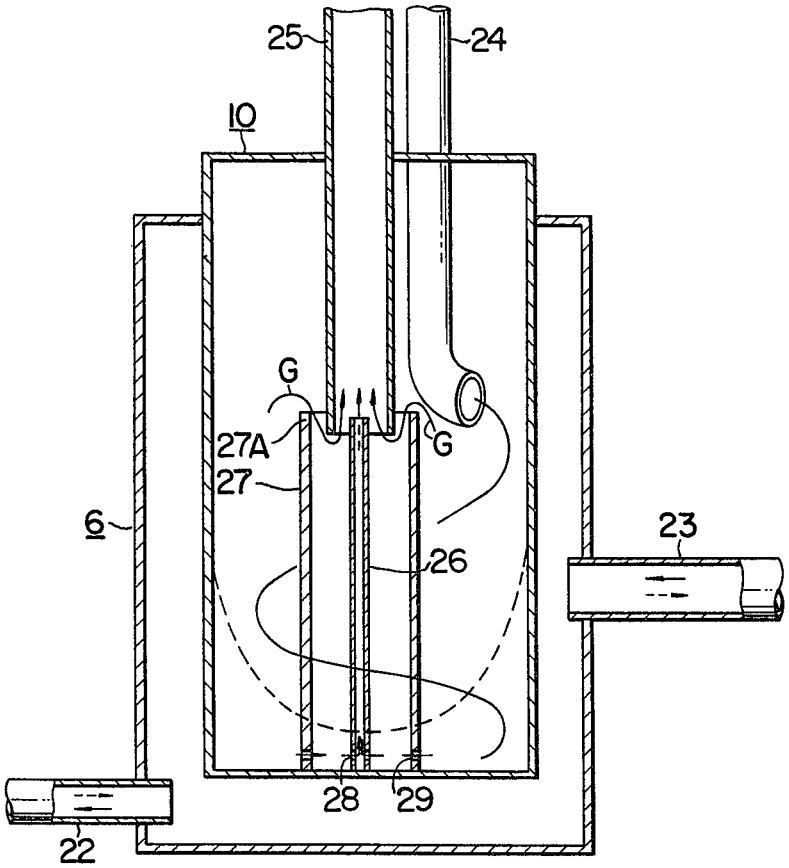
FIG. 5 is a sectional view of heat exchanger means for use in the second embodiment, consisting of an integral combination of the receiver and suction accumulator.

The upper part of the suction accumulator 10 is connected, as shown in detail in FIG. 5, with an injection pipe 24 for introducing the refrigerant from the four-way valve 2 and also with a suction pipe 25 for conducting the gas after the gas-liquid separation of the refrigerant back to the compressor 1. The injection pipe 24 is open into the suction accumulator 10, tangentially to the surrounding wall thereof. An oil induction pipe 26 is set upright on the bottom of the suction accumulator, the upper end of the pipe 26 being partly inserted into the suction pipe 25. Also on the bottom of the suction accumulator 10 is set an outer cylinder 27 upstanding to surround the oil induction pipe 26. The lower end portions of the oil induction pipe 26 and the outer cylinder 27 are formed with pluralities of oil suction holes 28 and oil intake holes 29, respectively.

The operation of this second embodiment will now be described. For the heating cycle, the hot compressed refrigerant gas delivered from the compressor 1 flows, in the direction indicated by broken-line arrows, through the four-way valve 2 into the indoor heat exchanger 9 that functions as a condenser during the heating operation. As the gas is liquefied through exchange of heat with air or water, the space heating is accomplished. The liquid refrigerant flows into the receiver 6 through the lower line 22 and thence into the decompression device 21 through the upper line 23. As it passes through the decompression device 21, the liquid refrigerant is decompressed and adiabatically expanded. Part of the refrigerant is thereby converted into a gas and a gas-liquid mixture of the refrigerant results. The mixture enters the outdoor heat exchanger 3 that serves as an evaporator during the heating cycle. There the mixture undergoes exchange of heat with air or water and pumps the heat while being further gasified. From the outdoor heat exchanger 3 the refrigerant is forced through the other path of the four-way valve 2 and the injection pipe 24 into the suction accumulator 10, where the gaseous portion of the refrigerant is separated from the liquid portion and is drawn into the suction pipe 25 and back to the compressor 1.

For the cooling cycle, the hot compressed refrigerant gas from the compressor 1 passes through the four-way valve 2 into the outdoor heat exchanger 3 that serves as a condenser during the cooling operation, where it is liquefied through heat exchange with air or water. The liquid refrigerant enters the decompression device 21, where it is decompressed to form a gas-liquid mixture. By way of the receiver 6, the mixture enters the indoor heat exchanger 9 that acts as an evaporator during the cooling operation. There it is vaporized to perform the space cooling while undergoing the heat exchange with air or water. After the vaporization the refrigerant flows through the other path of the four-way valve and the injection pipe 24 into the suction accumulator 10, where the gaseous refrigerant is separated from the residual liquid portion and is returned through the suction pipe 25 to the compressor 1.

This second embodiment is featured by the integral combination as a heat exchanger of the receiver 6, in which the liquid refrigerant at a relatively high temperature is collected, and the suction accumulator 10 where the refrigerant temperature is relatively low during the heating operation. Thus, if the outdoor temperature becomes lower and more liquid refrigerant flows into the suction accumulator 10 during the heating cycle, the compressor 1 will be advantageously protected against damage since the gaseous and liquid portions of the refrigerant can be centrifugally separated in the suction accumulator and, moreover, the liquid portion is vaporized by the exchange of heat with the liquid refrigerant at a relatively high temperature.

During the cooling operation, the low-temperature refrigerant in the form of a gas-liquid mixture from the decompression device 21 flows through the receiver 6. Consequently, there is no possibility of superheating the gas refrigerant in the suction accumulator 10 to excess.

The function of the suction accumulator 10 will now be explained. As shown in FIG. 5, the refrigerant in the form of a gas-liquid mixture swirls downwardly along the wall of the suction accumulator 10 and, during this descent, it is centrifugally separated into gaseous and liquid phases.

The liquid refrigerant, which is larger in mass than the gaseous refrigerant, is subjected to a greater centrifugal force and is forced closer to the surrounding wall. Therefore, the suction accumulator 10 mounted within the receiver 6 is heated, through its wall, by the liquid refrigerant at a relatively high temperature in the receiver, and thereby the vaporization of the liquid refrigerant in the accumulator is promoted. The gasified refrigerant is drawn into the suction pipe 25 as indicated by arrows G in FIG. 5. Inside the suction accumulator 10, the oil induction pipe 26 and the outer cylinder 27 combinedly form an oil-returning mechanism. Refrigerating machine oil, to be used for the lubrication of bearings in the compressor 1, is easily soluble in the refrigerant and is dissolved therein so that the mixture is circulated through the circuit. Collection of the refrigerating machine oil on the bottom of the suction accumulator can result in a shortage of oil in the compressor and inadequate lubrication of the bearings. It is to avoid this that the oil-returning mechanism is installed within the suction accumulator 10. The oil induction pipe 26 draws in by suction the oil collected on the bottom of the suction accumulator 10 through the holes 29, 28 and transfers it, together with the gaseous refrigerant, to the suction pipe 25 by the venturi action. The outer cylinder 27 is provided in order that the refrigerant in the form of a gas-liquid mixture issuing out of the injection pipe 24 be kept from entering the suction pipe 25 before being thoroughly separated into the gaseous and liquid portions.

This embodiment, wherein the receiver 6 is located between the indoor heat exchanger 9 and the decompression device 21 and is connected at its lower part to the lower line 22 for communication with the indoor heat exchanger 9 and at its upper part to the upper line 23 for communication with the decompression device 21, has the following advantages. During the heating operation the liquid refrigerant is collected up to the level of the upper line 23, but during the cooling operation the receiver 6 is mostly filled with the gaseous refrigerant, with negligible liquid collection. Thus, the amount of the refrigerant in the receiver 6, or in the refrigerant circuit, varies with the mode of operation, for cooling or heating. In other words, the (liquid) refrigerant is gathered in the receiver during the heating operation to allow less refrigerant to run through the circuit than during the cooling operation, so that the amount of the refrigerant available for the intended service can be appropriate at all times.

Figure 6:
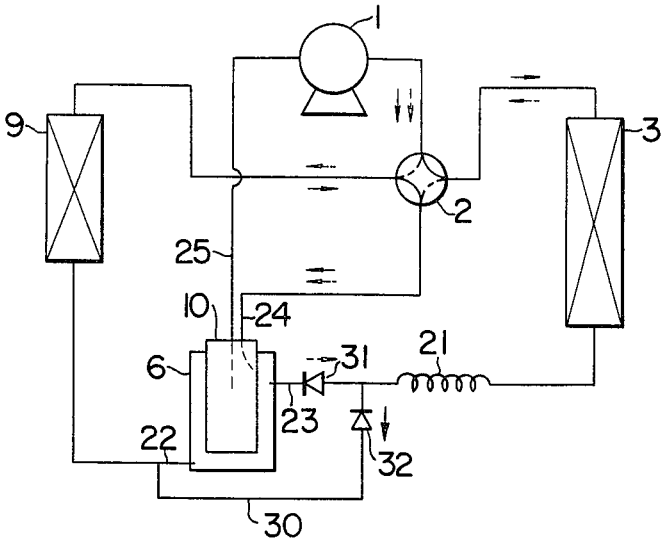
FIG. 6 is a flow diagram of still another embodiment of the invention, for illustration of the reversible operation cycle.

FIG. 6 shows still another embodiment, or a modified form of the arrangement in FIG. 4. It is similar to the preceding embodiment, except that the inlet and outlet of the receiver 6 are connected by means of a bypass pipe 30 and that the upper line 23 is provided with a first check valve 31 which permits the flow of the refrigerant only in the direction from the receiver 6 to the decompression device 21 and the bypass pipe 30 is provided with a second check valve 32 which permits the flow of the refrigerant only in the direction from the decompression device 21 to the indoor heat exchanger 9. In this embodiment, the refrigerant flows through the receiver 6 only in the heating operation, and through the bypass pipe 30 in the cooling operation. Therefore, the suction accumulator 10 is heated during the heating cycle to prevent the return of the liquid refrigerant to the compressor 1 and, during the cooling cycle when the liquid refrigerant present in the accumulator is so little that the vessel needs no heating, the refrigerant is flown through the bypass pipe 30. As a result, the heat exchange with the refrigerant in the suction accumulator 10 is more positively avoided than in the previous embodiment during the cooling cycle. This is helpful in preventing the overheating of the refrigerant gas returning to the compressor 1.

Figure 7:
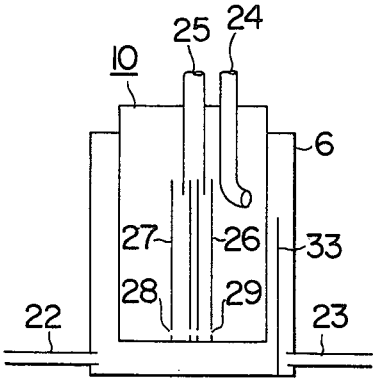
FIG. 7 is a sectional view of a modification of the heat exchanger means shown in FIG. 5, consisting of an integral combination of the receiver and suction accumulator.

FIG. 7 shows a modified form of the receiver 10 in FIG. 5. In this receiver 10 a partition 33 is set upright to a height near the upper part of the vessel and in front of the opening of the line 23 leading to the decompression device 21. This arrangement enables the receiver 10 to achieve the same effect as the counterpart in FIG. 3, despite the fact that the line 23 is not located above the lower line 22 but on the same level as the latter.

Figure 8:
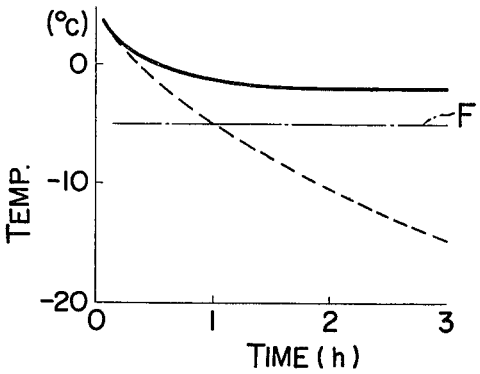
FIG. 8 is a graph summarizing the results of experiments with an ordinary air conditioner of the type and an embodiment of the invention.

FIG. 8 is a graph comparing the performance characteristics on the heating cycle of the reverse-flow air conditioner according to the invention and of a conventional air conditioner of the type. In the conventional unit the gas-liquid separation capacity of the suction accumulator 10 is not sufficient and, when the outside temperature falls during the heating operation, part of the refrigerant that leaves the outdoor heat exchanger 3 in the unvaporized state returns as it is to the compressor 1. The liquid refrigerant is gasified in the compressor chamber, thus lowering the temperature of the compressor 1 as a whole, the temperature of the gas being delivered out, and therefore that of the entire circuit. Consequently, an increased quantity of heat is required for the vaporization of the refrigerant and, as represented by the broken-line curve, the temperature of ambient air around the outdoor heat exchanger 3 drops rapidly. In about one hour after the start of the heating operation the outdoor heat exchanger 3 begins to become frosted. The frosting causes less refrigerant to be vaporized in the outdoor heat exchanger 3 and more liquid refrigerant to flow back to the compressor 1. With the conventional unit, therefore, it is customary to switch the heating operation over to defrosting at intervals of one to 1.5 hours and resume the heating cycle after the outdoor heat exchanger 3 has been freed of the frost.

The reverse-flow air conditioner of the invention, as embodied herein, prevents the return of the liquid refrigerant to the compressor 1 in the manner described. Therefore, as indicated by the full-line curve, the temperature of ambient air around the outdoor heat exchanger does not decline but remains stable, and defrosting is not necessary. Although a further drop of the outside temperature may call for a defrosting operation of the air conditioner of the invention, the frequency of the defrosting runs required will be far less than for the units of the conventional designs. The straight chain line F in FIG. 8 indicates the limit below which frosting takes place.

As described above, the air conditioner according to the invention does not require defrosting or, if any, a minimum frequency of defrosting runs depending on the indoor and outdoor temperatures at which it is operated. This brings the advantages of simplified construction, extended life, and increased reliability of the apparatus.

In the reverse-flow air conditioner of the invention, as already stated, heat exchanger means is provided in a line, through which the vaporized refrigerant from the indoor or outdoor heat exchanger flows on its way back to the compressor in the cooling or heating operation, so that the returning refrigerant is heated only during the heating cycle and not heated during the cooling cycle. The heat exchanger means heats and vaporizes the returning refrigerant during the heating operation, thereby preventing the return of the liquid refrigerant to the compressor and, during the cooling operation, transfers no heat to the returning refrigerant lest the super heat of the refrigerant back in the compressor should be high. Thus, the heat exchanger means protects the compressor against troubles during operation, either on the cooling or heating cycle, and, for that matter, incorporation of the means is of advantage to the air conditioners of the character.

While a preferred embodiment of the present invention has been described for a specific illustration and the advantages of its details, along with modifications and variations, further embodiments, variations and modifications are contemplated according to the broader aspects of the present invention, all as defined by the spirit and scope of the following claims.

What is claimed is:

1. A reverse-flow air conditioner for a selective operation on a heating cycle or a cooling cycle, comprising a compressor for delivering a hot compressed refrigerant gas, an indoor heat exchanger to act as the evaporator during the cooling cycle and as the condenser during the heating cycle, an outdoor heat exchanger to act as the evaporator during the heating cycle and the condenser during the cooling cycle, piping means interconnecting the compressor, outdoor heat exchanger, and indoor heat exchanger, a four-way valve for selectively connecting the compressor outlet to the indoor heat exchanger during the heating cycle and the outdoor heat exchanger during the cooling cycle, a receiver connected between the indoor heat exchanger and the outdoor heat exchanger in the piping means, decompression means in the piping means between the indoor heat exchanger and the outdoor heat exchanger for reducing the pressure of the liquid refrigerant condensed in and flowing from the indoor heat exchanger during the heating cycle and the outdoor heat exchanger during the cooling cycle to produce a mixture of gas and liquid refrigerant at reduced pressure and temperature, and a suction accumulator in the piping means between the suction inlet of the compressor and the four-way valve for separating refrigerant into gas and liquid portions, with the four-way valve feeding the refrigerant from the outdoor heat exchanger to the suction accumulator during the heating cycle and from the indoor heating exchanger to the suction accumulator during the cooling cycle, wherein the improvement comprises in combination:

the suction accumulator and receiver being in heat exchange relationship with each other;

the decompression means being a single fluid flow restriction connected between the outdoor heating exchanger and the receiver and providing substantially the sole pressure drop for both the heating cycle and the cooling cycle; and the piping means between the indoor heat exchanger and the receiver opening into the receiver at a position spaced a substantial vertical distance below the position where the piping means from the decompression means opens into the receiver, so that the receiver will store a quantity of liquid refrigerant during the heating cycle that is greater than that stored during the cooling cycle by an amount equal to the volume of the receiver between such vertically spaced openings.

2. The apparatus of claim 1, wherein said piping means directs all of the refrigerant flowing from the outdoor heat exchanger and the compression means through the receiver to the indoor heat exchanger for heat exchange with all of the refrigerant flowing from the indoor heat exchanger through the suction accumulator to the compressor during cooling, and directs all of the refrigerant flow from the indoor heat exchanger through the receiver to the decompressor means and outdoor heat exchanger for heat exchange with all of the refrigerant passing from the outdoor heat exchanger through the suction accumulator to the compressor during the heating cycle.

3. The apparatus of claim 1, further including said piping means having a bypass line between the decompression means and the indoor heat exchanger, a check valve between the decompression means and the receiver, and a check valve in the bypass line, so that during cooling refrigerant flows from the outdoor heat exchanger through the decompression means and through the bypass line to the indoor heat exchanger without passing through the receiver and during the heating cycle refrigerant flows from the indoor heat exchanger through the receiver and decompression means to the outdoor heat exchanger.

4. The apparatus of claim 1, wherein said accumulator has a bottom where oil mixed with the refrigerant will tend to collect, and said piping means includes a suction pipe, leading to the compressor suction inlet, opening into the accumulator at a distance considerably above the bottom of the accumulator; and further including an induction oil pipe extending from the bottom of the accumulator upwardly to the suction opening of the suction pipe, said oil induction pipe having an oil inlet opening adjacent the bottom of the accumulator and an oil outlet adjacent the inlet opening of the suction pipe so that gaseous refrigerant being sucked by said compressor through the suction pipe inlet will draw oil from the bottom of the accumulator through the oil induction pipe and through the outlet of the oil induction pipe to mix with the gaseous refrigerant pressing to the compressor suction inlet.

5. The apparatus of claim 4, wherein the uppermost portion of the oil induction pipe extends into and is spaced from the walls of the suction pipe, and further including an outer pipe extending around the oil induction pipe from the bottom of the accumulator to its upper end where it extends around and spaced from the suction pipe, and the outer pipe including an oil intake opening adjacent the bottom of the accumulator.

6. The apparatus of claim 3, wherein said accumulator extends from a position substantially below to a position substantially above the pipe opening into the receiver from the decompression means, and is in heat exchange relationship with the receiver between such positions so that the liquid stored in the receiver during the heating cycle will be in direct contact with the accumulator for heat exchange.

7. A reverse-flow air conditioner for a selective operation on a heating cycle or a cooling cycle, comprising a compressor for delivering a hot compressed refrigerant gas, an indoor heat exchanger to act as the evaporator during the cooling cycle and as the condenser during the heating cycle, an outdoor heat exchanger to act as the evaporator during the heating cycle and the condenser during the cooling cycle, piping means interconnecting the compressor, outdoor heat exchanger, and indoor heat exchanger, a four-way valve for selectively connecting the compressor outlet to the indoor heat exchanger during the heating cycle and the outdoor heat exchanger during the cooling cycle, a receiver connected between the indoor heat exchanger and the outdoor heat exchanger in the piping means, decompression means in the piping means between the indoor heat exchanger and the outdoor heat exchanger for reducing the pressure of the liquid refrigerant condensed in and flowing from the indoor heat exchanger during the heating cycle and the outdoor heat exchanger during the cooling cycle to produce a mixture of gas and liquid refrigerant at reduced pressure and temperature, and a suction accumulator in the piping means between the suction inlet of the compressor and the four-way valve for separating refrigerant into gas — and liquid portions, with the four-way valve feeding the refrigerant from the outdoor heat exchanger to the suction accumulator during the heating cycle and from the indoor heating exchanger to the suction accumulator during the cooling cycle, wherein the improvement comprises in combination:

wherein said piping means directs all of the refrigerant flowing from the outdoor heat exchanger and the compression means through the receiver to the indoor heat exchanger for heat exchange with all of the refrigerant flowing from the indoor heat exchanger through the suction accumulator to the compressor during cooling, and directs all of the refrigerant flow from the indoor heat exchanger through the receiver to the decompressor means and outdoor heat exchanger for heat exchange with all of the refrigerant passing from the outdoor heat exchanger through the suction accumulator to the compressor during the heating cycle so that the refrigerant decompression means will be common to both the heating cycle and the cooling cycle.

8. The apparatus of claim 7, wherein the uppermost portion of the oil induction pipe extends into and is spaced from the walls of the suction pipe, and further including an outer pipe extending around the oil induction pipe from the bottom of the accumulator to its upper end where it extends around and spaced from the suction pipe, and the outer pipe including an oil intake opening adjacent the bottom of the accumulator.

9. The apparatus of claim 1, wherein said receiver surrounds said accumulator, and the bottom of said accumulator is spaced above the bottom of said receiver and above the opening of said piping means from the indoor heat exchanger to the receiver; the bottom of the accumulator being below the opening of the piping means into the receiver leading to the decompression means, so that the accumulator will be emersed in liquid refrigerant only during the heating cycle.

* * * * *